US005613543A

United States Patent [19]

Walton

[11] Patent Number: 5,613,543

[45] Date of Patent: Mar. 25, 1997

[54] TEMPORARY PROTECTIVE COVERING SYSTEM

[76] Inventor: Ronald W. Walton, 1906 S. Crescent, Champaign, Ill. 61821

[21] Appl. No.: 346,690

[22] Filed: Nov. 30, 1994

[51] Int. Cl.[6] ..... A47H 1/00

[52] U.S. Cl. ..... 160/265; 160/351; 135/119

[58] Field of Search ..... 160/351, 273.1, 160/265; 135/900, 907, 908, 119, 115, 95; 182/129

[56] References Cited

U.S. PATENT DOCUMENTS

| | | | |
|---|---|---|---|
| 158,455 | 1/1875 | Babson et al. . | |
| 193,573 | 7/1877 | Tripp . | |
| 1,546,848 | 7/1925 | Lundgren | 160/265 |
| 2,466,155 | 4/1949 | Conrad . | |
| 2,986,150 | 5/1961 | Torian | 135/115 X |
| 3,155,427 | 11/1964 | Necessary | 135/900 X |
| 3,240,217 | 3/1966 | Bird et al. | 135/119 X |
| 3,510,996 | 5/1970 | Popil . | |
| 3,586,126 | 6/1971 | Eickhof . | |
| 3,749,107 | 7/1973 | Laberge | 135/115 X |
| 3,805,816 | 4/1974 | Nolte . | |
| 4,083,149 | 4/1978 | Hickman et al. . | |
| 4,124,196 | 11/1978 | Hipskind . | |
| 4,229,914 | 10/1980 | Lucas | 135/119 X |
| 4,738,335 | 4/1988 | Ishii . | |
| 4,744,403 | 5/1988 | Hausmann et al. | 160/273.1 X |
| 4,852,687 | 8/1989 | Hittler . | |
| 4,979,589 | 12/1990 | Sugiyama et al. . | |
| 4,982,534 | 1/1991 | Saitoh et al. . | |
| 4,984,399 | 1/1991 | Taylor . | |
| 5,038,517 | 8/1991 | Talbott . | |
| 5,038,889 | 8/1991 | Jankowski . | |
| 5,197,240 | 3/1993 | Eryou . | |
| 5,201,152 | 4/1993 | Heffner . | |

FOREIGN PATENT DOCUMENTS

| | | |
|---|---|---|
| 2217826 | 10/1973 | Germany . |
| 3014724 | 10/1981 | Germany . |
| 3539362 | 5/1987 | Germany . |
| 3716552 | 12/1988 | Germany . |
| 9305738 | 6/1993 | Germany . |
| 518040 | 5/1940 | United Kingdom . |
| 8603538 | 6/1986 | WIPO . |
| 9423153 | 10/1994 | WIPO . |

*Primary Examiner*—Blair Johnson
*Attorney, Agent, or Firm*—Gunn & Associates, P. C.

[57] ABSTRACT

The present invention provides temporary protection of outside objects from wind, rain, snow, or other elements. In particular, the present invention is a system of supports and fabric or plastic panels that are erected to provide a continuous protective covering over an area, structure, or object. The components of the system may be assembled in various configurations as the situation demands. The system requires minimal labor to install and the covering can be readily raised and lowered as desired.

29 Claims, 6 Drawing Sheets

FIG. 2
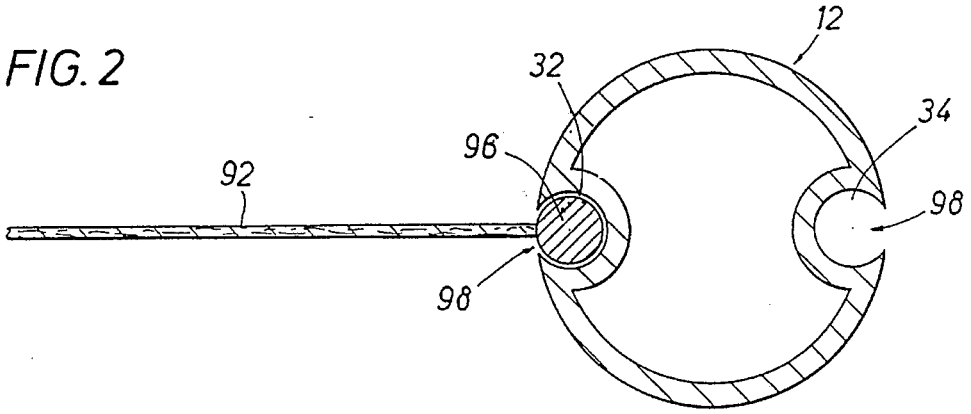
FIG. 5b
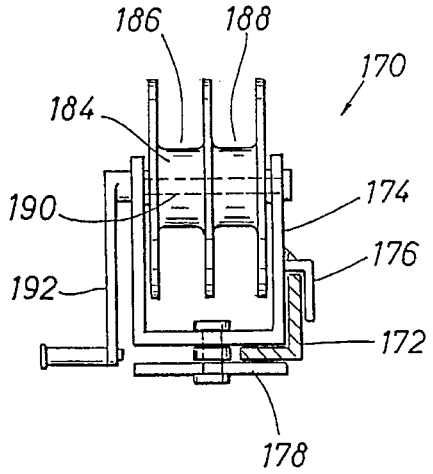
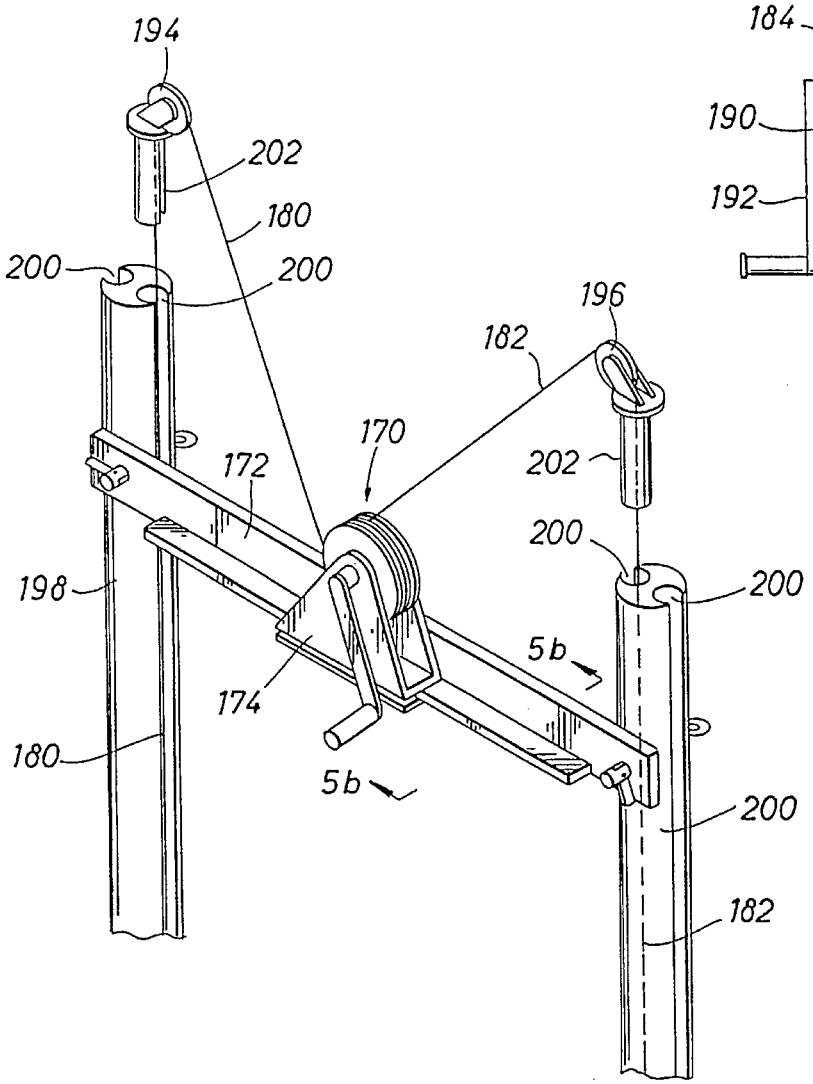
FIG. 5

FIG. 6
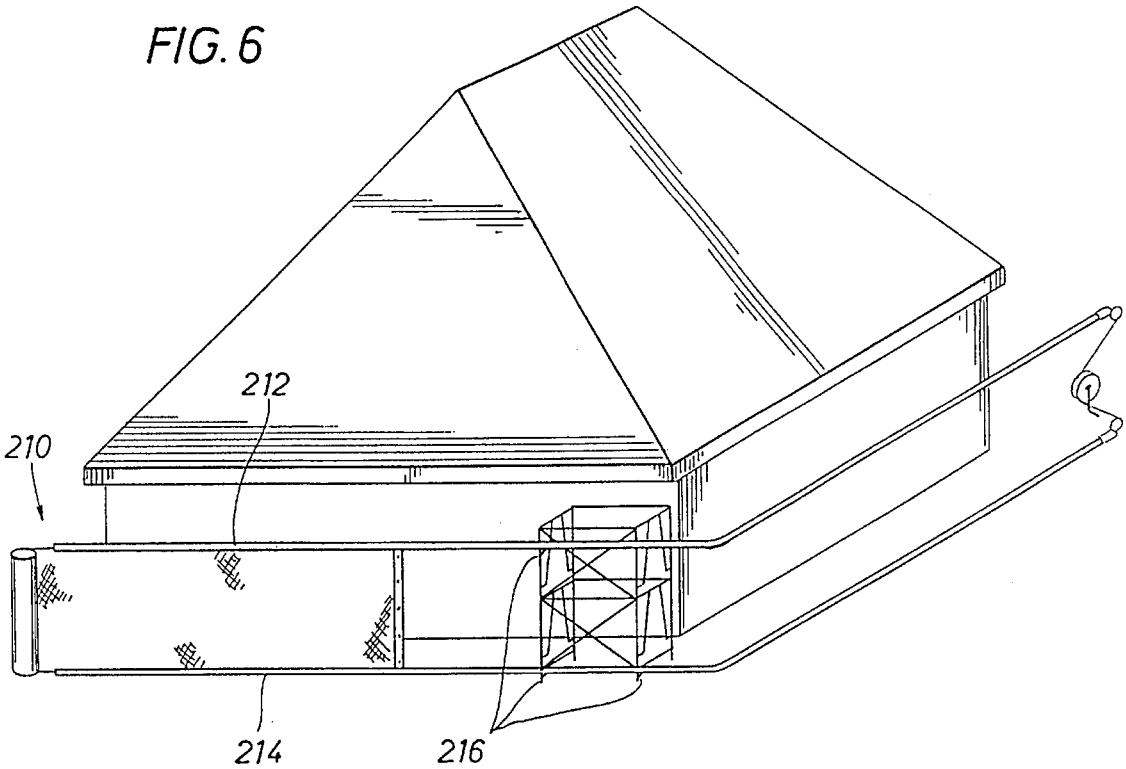
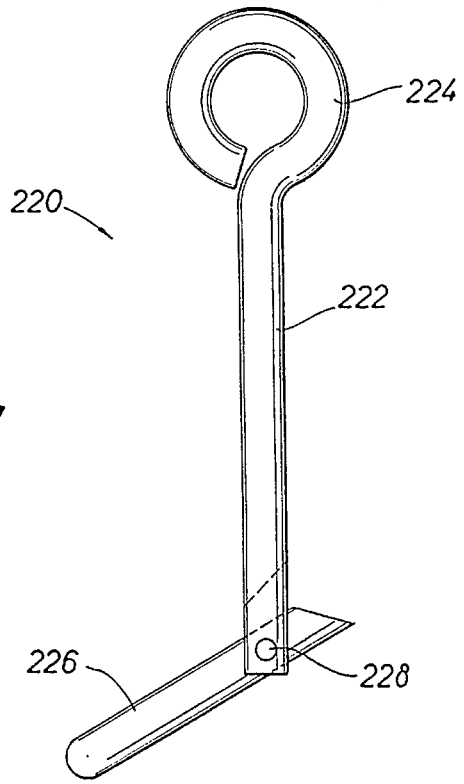
FIG. 7

TEMPORARY PROTECTIVE COVERING SYSTEM

FIELD OF THE INVENTION

The present invention relates to the temporary protection of outside objects from wind, rain, snow, or other elements. In particular, the present invention is a system of supports and fabric panels that are capable of being erected to provide a continuous protective covering over an area, structure, or object.

BACKGROUND OF THE INVENTION

In the construction industry, it is frequently desirable to protect workers and buildings under construction from the weather. Contractors normally erect scaffolding around the outside of structures upon which the work is to be performed. Such scaffolding provides support for workers and tools so that work may be done on the structure at elevated levels. Scaffold enclosures are generally applied to the outside of the scaffolding, after it has been erected to create a weatherproof environment around the scaffold and the structure. Prior art scaffold enclosures have frequently been complicated and cumbersome, and they have required significant expense and time to erect. The enclosures have also been difficult to open or close as needed.

U.S. Pat. No. 3,586,126 to Eickhof discloses an elongated framework constructed with sufficient rigidity for mounting between a pair of shorings and depending scaffolding therefrom. A roll of flexible protective material is affixed to the framework to produce at least a partial enclosure about a work area when in at least a partially unrolled position. Means are affixed to the framework for supporting the roll of material and providing the rolling and unrolling action thereof.

U.S. Pat. No. 3,805,816 to Nolte discloses a protective covering for sheltering all sides of a scaffold. A rectangular covering element has hook-shaped telescoping profile bars and clamping lugs on two sides thereof, while the opposite sides have slots for receiving connection cables. Vertically adjacent covering elements are pushed or slipped into each other by means of hook-shaped profile bars which are secured to the edge of each covering element and which telescope into one another. Clamping lugs hold adjacent bars together. Horizontally adjacent cover elements overlap one another and are attached to the vertical struts of the scaffold construction by means of individual connection cables fitted through slots and individually ties around the vertical strut. Alternatively, an alligator clip-like cable may be utilized for this purpose.

U.S. Pat. No. 3,995,715 to Vitanen discloses a scaffold enclosure having a plurality of plastic sheets with beaded portions which are held together in a related assembly to the scaffolding by attachment members which partly surround the beaded portions.

U.S. Pat. No. 5,038,889 to Jankowski discloses a scaffold enclosure having a plurality of panels with hook and loop closure straps for securing the panel to various scaffold struts. Each panel also has continuous strips of hook and loop closures on the inner and outer surfaces at each edge. The panels may be engaged on one another to form a barrier.

However, the scaffold enclosures noted above suffer in several aspects which make burdensome or impractical to use. For some of the enclosures, the assembly is time and labor intensive. Some of the enclosures require intricate positioning and securing of individual panels which consumes so much time and labor as to negate any advantage that the enclosures provide.

Yet another limitation of these enclosures is that the barrier cannot be easily opened or closed. Certain enclosures that are fixed to the scaffold cannot be opened without disassembling the enclosure. Because this is so time consuming, the enclosure is typically left in place until the entire project is finished even though the enclosure may be in the way at certain points in the construction process.

When the weather is pleasant and sunny, it is useful to open the enclosure and let the sun light up the construction area or assist drying of materials. In addition, it is frequently necessary to remove portions of the enclosure to allow passage of materials and equipment to the structure. Conversely, during cold, windy, or wet weather it would be desirable to close the enclosure to protect the construction and the workers. If extremely high winds from storms, tornadoes, or hurricanes are present, the enclosure should be opened to allow the wind to pass through the scaffold rather than risk the scaffold being blown down. It is desirable to have a scaffold enclosure that could be routinely used at construction sites to improve control over construction scheduling and avoid delays Furthermore, it is desirable to have a scaffold enclosure that requires little storage space, takes low maintenance, and has a low cost.

SUMMARY OF THE INVENTION

The present invention provides a temporary protective covering system comprising a plurality of vertical support poles comprising at least two elongate support members coupled together, each support pole having a first end resting on a substantially even surface, a second distal end, two guide channels, and means for securing the support poles in a spaced relation; a plurality of elongate cross braces having two ends coupled to adjacent support poles; thin flexible panels between each pair of adjacent support poles having a width spanning between adjacent support poles, a length substantially equal to the height of the vertical support poles, and two interlocking lateral edges slidably held within the guide channels of adjacent support poles; and means for controllably raising and lowering each flexible panel secured between the distal ends of adjacent support poles. The system may be configured in many ways to provide a continuous protective covering to an area, structure, or object..

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 2 is a cross sectional view of a support pole from FIG. 1 taken along line 2—2 shown with C-shaped guide channels therein;

FIG. 5 is a partially exploded perspective view of a winch and pulley assembly;

FIG. 5(*b*) is a cross sectional view of FIG. 5 showing the attachment of the winch to a cross brace;

FIG. 6 is a plan view of a protective covering system configured horizontally around a building;

FIG. 7 is a locking pin with an eyelet for securing cross braces to the support poles.

DETAILED DESCRIPTION OF THE PREFERRED EMBODIMENT

The present invention is a temporary protective covering system that can be installed by one or two people without special tools. The system has only a few components which can be assembled in a vast number of configurations. The reduced number of components makes the enclosure simpler and quicker to assemble than many previous enclosures.

The system of the present invention can be used in various applications, such as: temporary barriers to control and direct fresh air circulation in the mining industry; area containment and isolation of hazardous materials and environmental control, such as in the nuclear industry, lead abatement for paint removal, and large sand blasting and dust producing operations; tenting for athletic events, camping, and other outside events; temporary or semi-permanent greenhousing, hydroponics enclosures, hay or grain storage and the like; shelters for animal containment such as dog kennels, livestock and animal husbandry, and the like; construction or maintenance of buildings, structures, and outdoor objects with or without the use of scaffolding.

Figure 1:
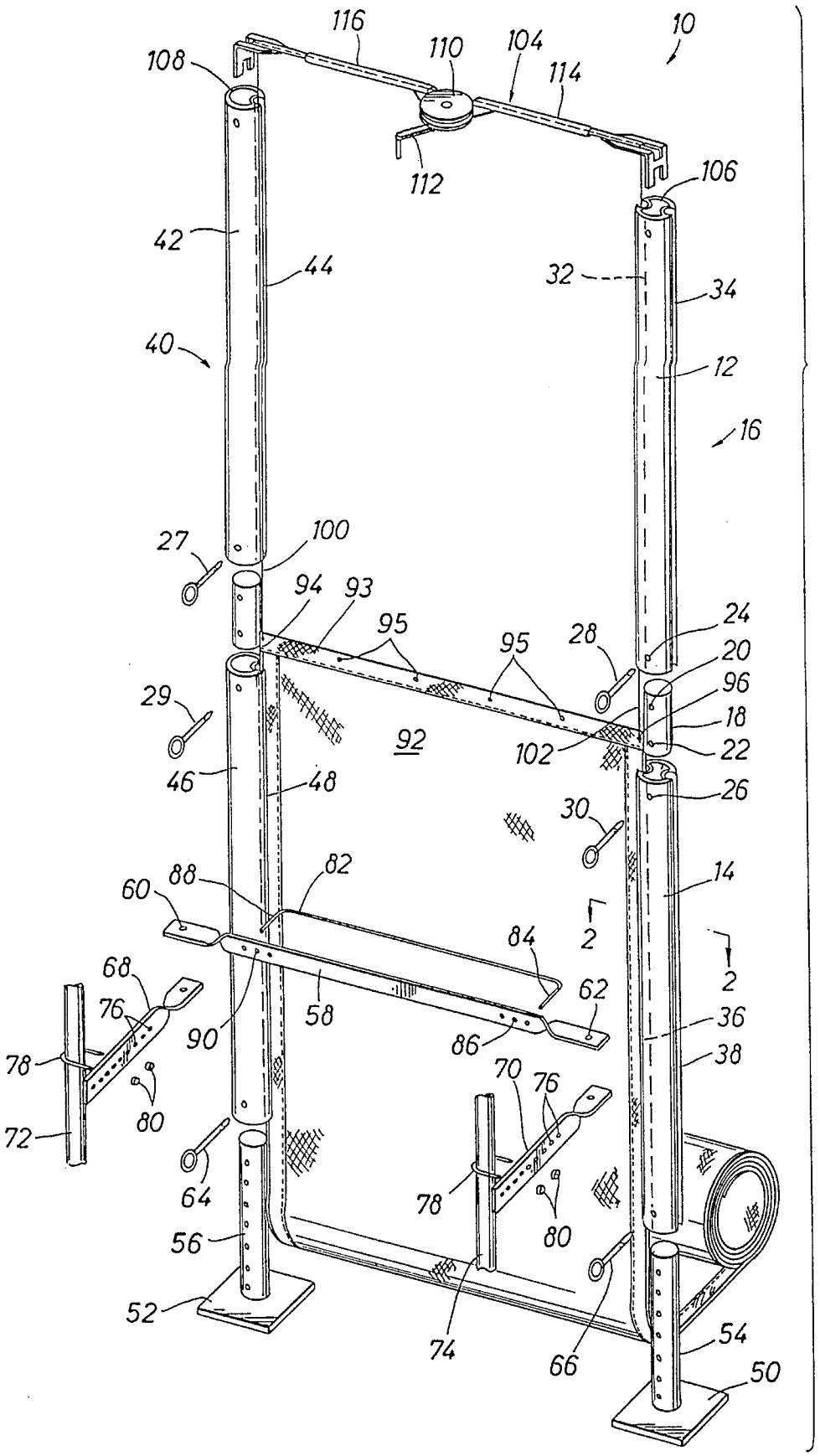
FIG. 1 is an exploded assembly view of a protective coveting system.

Referring to FIG. 1, the components of a protective covering system 10 are shown in an exploded assembly view. Elongate support members 12 and 14 are coupled together to form a vertical support pole 16. The elongate support members 12 and 14 can be coupled in various ways, including male and female connections, but are shown here as a male-male coupling 18. The pin insert holes 20 and 22 in coupling 18 are matched up with the pin insert holes 24 and 26, respectively, so that lock pins 28 and 30 can be inserted to secure the coupling in place.

The elongate support member 12 has guide channels 32 and 34 on opposing sides of the member 12. The pin holes of members 12 and 14, as well as the pins in the coupling 18, are aligned vertically so that the guide channels 32 and 34 match up with guide channels 36 and 38 of support member 14. Channels 32, 34, 36, and 38 line up to form two opposing channels that extend substantially the length of the vertical support pole 16. It is preferred that the channels be interior to the support poles (as shown in FIG. 2)

While pole 16 has two opposing channels, pole 40 has only one channel made up of channel 44 of elongate support member 42 and channel 48 of elongate support member 46. The channels 34 and 38 may be utilized to guide the edge of a second panel extending in the opposing direction (to the right in FIG. 1). Support poles can be provided with a second channel at any angle, from zero to 360 degrees, from the first channel. By arranging an alternative series of poles and panels, always having a pole on both sides of a panel, a continuous barrier that turns corners can be assembled.

Poles 16 and 40 are mounted on bases 50 and 52, respectively, having vertical adjusting bars 54 and 56 with several vertically aligned holes which allow for minor adjustments in the height of the support poles 16 and 40. Upward or downward adjustment of the poles may be necessary where the ground upon which the covering is assembled is somewhat uneven.

Vertical support poles 16 and 40 are held upright by the frame braces 68 and 70 which connect to or extend from the support poles. The poles 16 and 40 are connected to the bases 50 and 52 by pins 64 and 66. Adjacent structures include support structures such as a scaffold and one example of a rigid structure is the legs 72 and 74 of an adjacent scaffold The frame braces 68 and 70 are detachably coupled to the scaffold leg using any means, including U-bolts and nuts. The frame braces 68 and 70 may have a series of bolt holes 76 or a slot (not shown) through which to connect the U-bolts 78 and nuts 80 in order to accommodate variations in the distance between the support pole and the scaffold.

The poles 16 and 40 are tied together at a fixed distance apart by using the cross brace 58. The holes 60 and 62 in the ends of brace 58 allow the brace 58 to be secured to the poles at various heights. While the poles may have additional holes through which to attach the brace, it is preferred to simply attach the brace 58 using a lock pin connecting the support members to the base, such as pins 64 and 66, and/or connecting support members to each other, such as lock pins 27 and 28 or lock pins 29 and 30.

Referring briefly to FIG. 7, a lock pin 220 has a shaft 222, an eyelet 224, and a hinged tail 226. The hinged tail 226 is coupled to the shaft 222 by a rivet 228. The lock pin 220 is used to couple various member together by positioning the hinged tail 226 in a linear arrangement with the shaft 222 and inserting the tail and shaft through a pin hole. The tail portion 226 is pulled through the hole until the hinged tail 226 can be rotated perpendicular to the shaft. The length of the shaft 222 between the eyelet 224 and the rivet 228 should be sufficient to pass through the coupled members and rubber washers there between, but not so long as to allow slack between the members. The eyelet 224 is useful for securing shock cords attached to custom cut fabric panels or anchoring guys.

Referring back to FIG. 1, an elongate panel 92 made of a fabric or polymer sheet is provided with interlocking edges 94 and 96 that are slidably held within the guide channels 44/48 and 32/36, respectively. The guide channels may take any shape, but are preferably C-shaped with a constant diameter and an elongate opening that extends over the length of the guide channel. It is preferred that the opening or mouth of the channel be directed away from the support pole and positioned around the pole 90 degrees from the pin holes 24 and 26.

Referring briefly to FIG. 2, a cross section of the support pole 16 taken along line 2 in FIG. I is shown with C-shaped guide channels 32 and 34 therein. The pole 16 is typically made of a light-weight metal, such as aluminum, and is preferably hollow to minimize the weight of the system while maintaining its strength.

FIG. 2 also illustrates that the interlocking edge 96 of the panel 92 has a diameter less than the diameter of the channel 32 but greater than the width of the openings 98. Having these relative dimensions allows the interlocking edge 96 to be slidably held within the guide channel 32 while permitting the elongate flexible panel to extend through the opening 98.

Referring back to FIG. 1, the panel 92 may be made of a variety of fabrics or plastic sheeting having sufficient strength to withstand wind loads and driving rain. The top edge 93 of the panel 92 is folded over and sewn for increased strength. A set of eyelets 95 are placed in the folded top edge 93 for securing custom panels (not shown).

A panel tensioner 82 is attached to the cross brace 58 in order to put tension on the panel and prevent it from flapping in the wind. The tensioner 82 is a strong flexible material, typically a steel rod. One end of the tensioner 82, such as end 84, is inserted into a hole 86 in the cross brace 58. The tensioner 82 is then bowed outwards toward the panel until the proper tension is achieved. Then the other end 88 of the tensioner 82 is inserted into a hole 90.

The system also includes means for controllably raising and lowering the flexible panel. The panels may be raised and lowered by hand or any other means. As shown in FIG. 1, the system may include a pair of cables 100 and 102 connected to the top interlocking edges 94 and 96 of the panel 92. The cables 100 and 102 pass upward from the panel 92 through the channel 32 to a halyard winch 104.

The winch 104 may have arms 114 and 116 which are secured to the distal ends 106 and 108 of the adjacent support poles 16 and 40, respectively. However, referring now to FIG. 5 and 5(*b*), it is preferred that the winch 170 be detachably secured to an angle iron cross brace 172 so that a single winch and a pair of cables can be used to raise all the fabric panels consecutively. The winch 170 includes a frame 174 that can be attached to the cross brace 172 by setting the mounting channel 176 of the frame 174 over the back of the brace 172 and rotating the locking bar 178 into a position under the brace 172. Secured in this fashion, the winch 170 is free to slide along the brace 172 as necessary to equalize the tension on the pair of cables 180 and 182. The winch 170 further includes a drum 184 with dual tracks 186 and 188 for receiving the cables 180 and 182, respectively. A shaft 190 is placed through the center of the drum 184 and extending through both sides of the frame 174. One end of the shaft 190 is connected to a crank 192 for turning the drum 184.

Referring to FIG. 5, pulleys 194 are temporarily mounted on the distal ends of the support poles 198. These pulleys 194 have a male extension 202 which fits snugly into the C-channel 200 of each support pole 198. The pulleys 194 allow the cables 180 and 182 to be pulled in a direction linear to the C-channels 200, thereby reducing the force required to raise the fabric.

Referring back to FIG. 1, the winch 104 allows the cables 100 and 102 to communicate with a spool or drum 110 to which they are attached. The drum 110 has a hand crank 112 or other hand-operated or electronic means for turning the drum. The cables are attached to the drum so that rotation of the drum causes tension on the cables. Further rotation causes the cables to be wound onto the drum and the attached panel to be raised. The drum can be rotated in the opposite direction to lower the panel.

The components of the system just described can be configured in a variety of ways. The system can be made taller by linking additional support members to the vertical support poles. The system can be made wider by installing a plurality of vertical support poles and panels across the desired area. The poles may be positioned in a straight line, a curve, or an angle as needed for protection of the construction area. When the system is configured into a three dimensional structure, it is possible for the system to stand alone.

Referring now to FIG. 6, the present invention may be used economically in applications that are much wider than tall, such as covering the walls of a single story building. As shown in FIG. 6, the system 210 can be mounted with the support poles 212 and 214 in a horizontal arrangement. Stanchion adapters 216 can be used to connect the poles at standard lock pin positions. In this configuration, fewer fabric panels and less labor are required.

Figure 3:
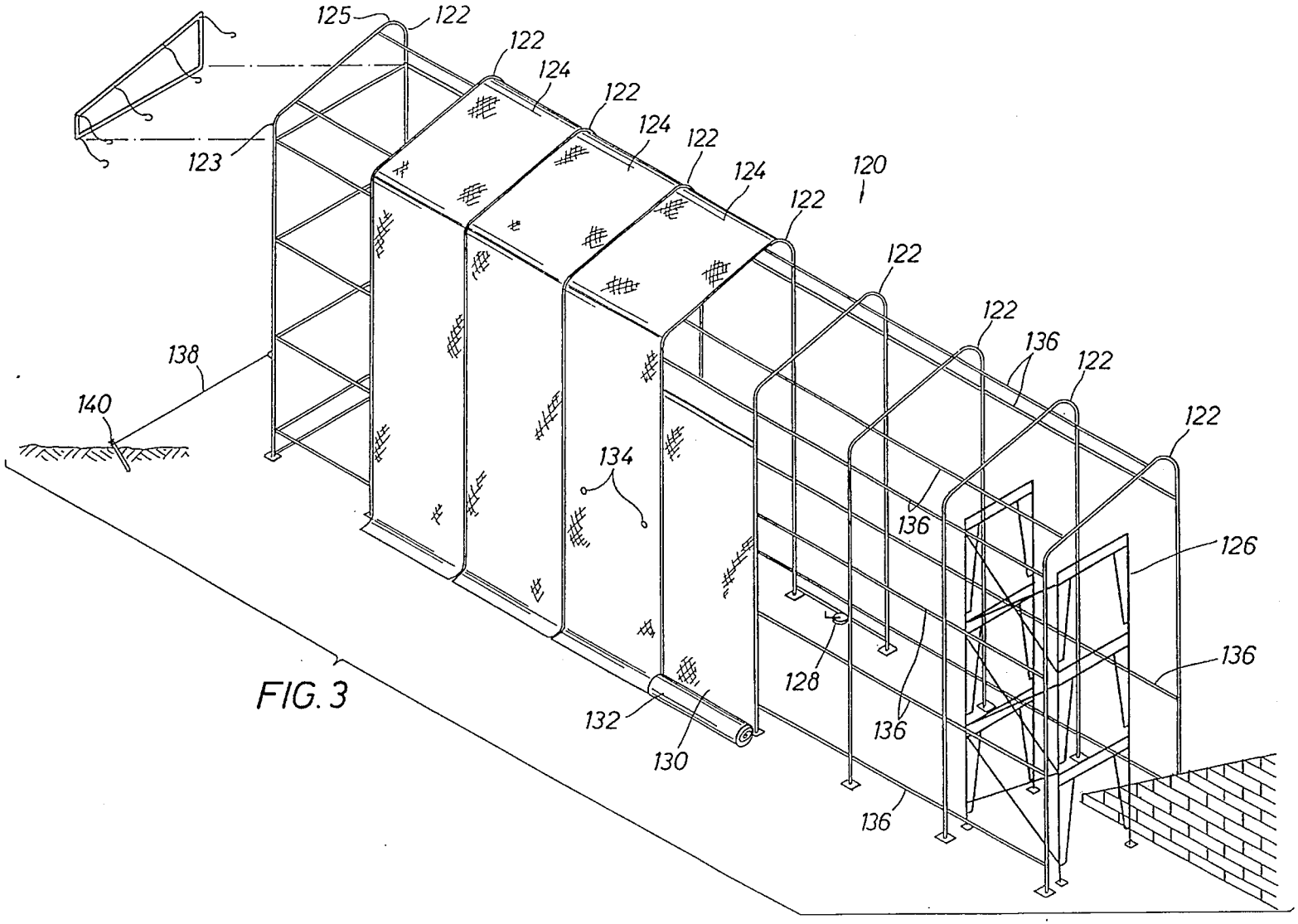
FIG. 3 is a plan view of a protective covering system enclosing a scaffold erected for the laying a brick wall.

Another useful configuration of the system of the present invention is shown in FIG. 3. The system 120 includes nine support poles 122 spaced a uniform distance apart to accommodate up to eight elongate panels. The poles 122 are comprised of a combination of straight and curved support members to form inverted frame sweep bends. The frame sweep bends shown provide enclosed protection over a space sufficient for a three tier scaffold system 126 to be constructed for the laying of a brick or concrete block wall.

The curved or bent support members 123 and 125 can have any degree of deflection so long as the panel's interlocking edge does not bind in the channel. However, members 123 and 125 will typically have a 60 degree deflection in order to establish a 30 degree roof slope. When the system is configured horizontally, the sweep bends may be 90 degrees to provide for corner turns.

A winch 128 is placed at the distal end of the poles, which is now located at ground level. The cables pass upward and over the top portion of the poles and attach to a panel which is typically rolled or folded near the front base of the system. For purposes of illustration, only three panels 124 are shown to be fully extended into the enclosed position. The panel 130 is shown only partially closed with a portion of the panel 130 remaining in a roll at point 132.

Once a panel is fully extended into the inverted U-shaped configuration, the weight of panel material is substantially the same on both sides of the system. Therefore, retracting the panel may require a downward pull on the front portion of the panel in addition to releasing cable from the winch. Alternatively, weights 134 may be hung on the front portion of the panel so that there is always tension on the panel and cables and a single person can open the protective covering.

Note that the cross braces 136 are necessary for the system to have sufficient rigidity to stand upright and resist winds and rain. In certain circumstances such as this, it might be beneficial to secure the system 120 in place with a cable 138 and stake 140. Furthermore, rubber washers may be placed between each of the members connected, such as between the support member 14, the cross brace 58, and the frame brace 70, in order to provide additional stability to the system.

When the system is configured for a specific application, there may be certain areas of the enclosure that are not readily covered with the slidably held panels. Areas which are typically smaller than the elongate panels and/or non-rectangular, may be covered with custom cut sheets of the panel material tied to support poles, cross braces, and the eyelets along the top edge of the elongate panels.

Figure 4:
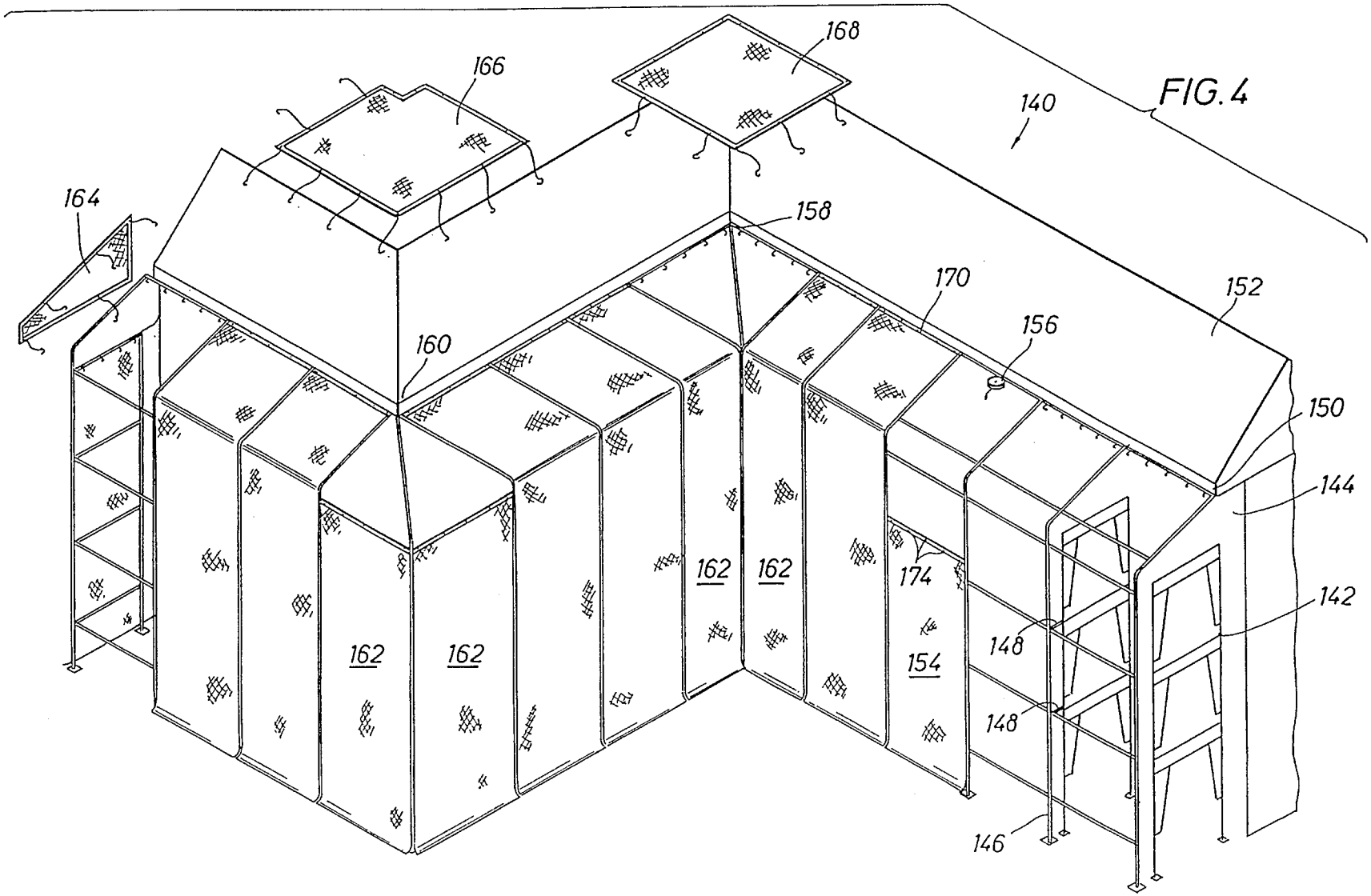
FIG. 4 is a plan view of a protective covering system enclosing a scaffold erected against a building wall.

Referring now to FIG. 4, another configuration of the system of the present invention 140 is shown covering a scaffold 142 against an existing wall 144. The support poles 146 are attached to the scaffold at various points 148 and extend up and over the scaffold to make contact with the eave 150 of the roof 152. Panel 154 is shown being partially raised by the winch 156.

Because the system 140 turns an interior corner 158 and an exterior corner 160, the standard elongate panels 162 are unable to provide seamless coverage of the construction area. Therefore, custom panels 164, 166, and 168 are secured into place with standard S-hooked shock cords extending from the custom panels to eye bolts or toggle lock pins with eyelets (see FIG. 7) located at the various connections between support poles and cross braces. It is also possible to fasten the shock cords to the eyelets located along the top edge of the panels.

Figure 8:
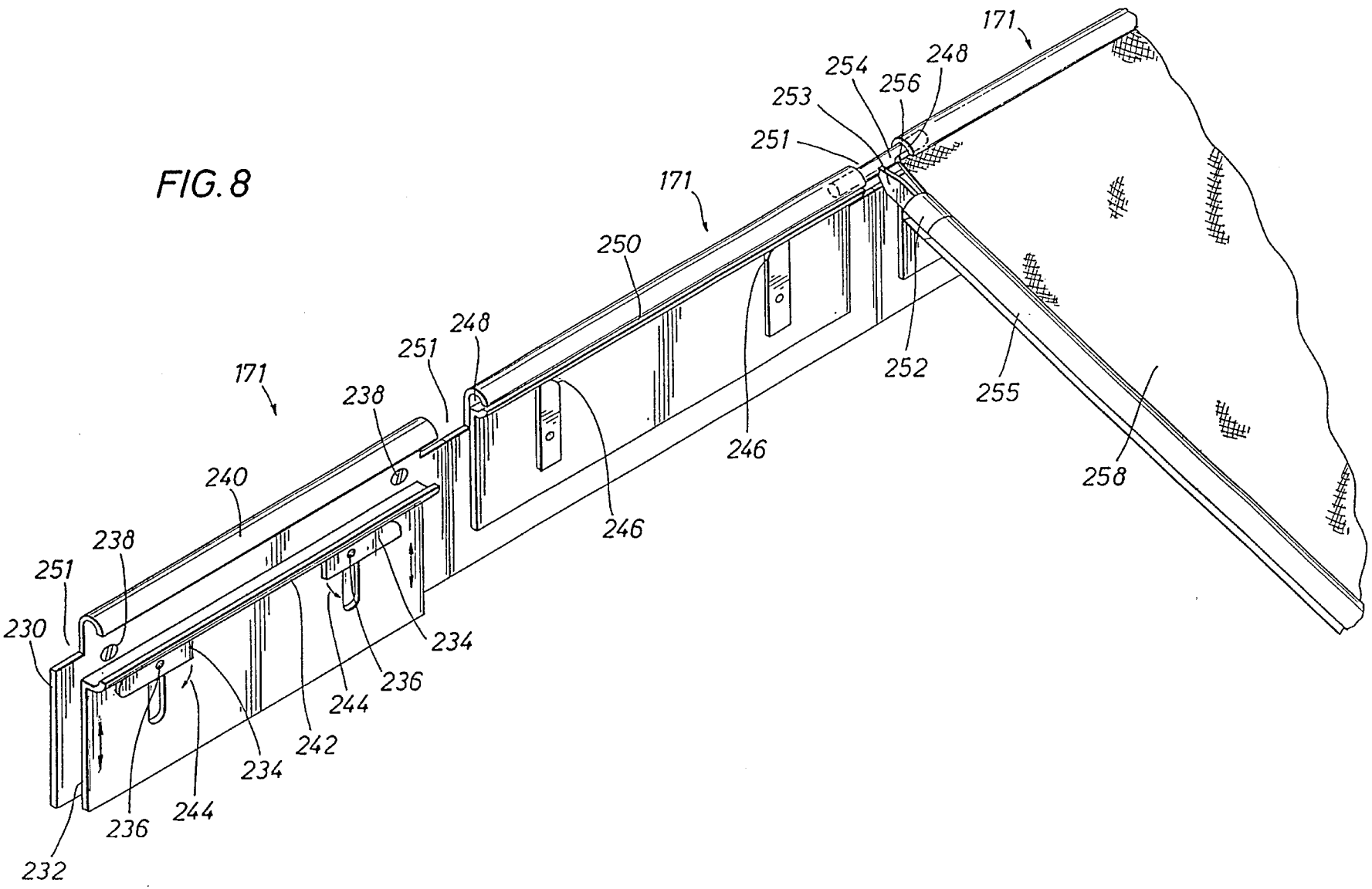
FIG. 8 is a perspective view of a soffit and facia attachment for securing the support poles and fabric to a wall in a weather tight arrangement.

A wall soffit and facia attachment 171 may be secured to the wall 144 or cave 150 for holding the support poles and fabric thereto in a continuous, weather tight manner. Referring now to FIG. 8, the attachment 171 is shown in greater detail. The attachment includes a base plate track 230, a sliding lock track 232, and multiple cam lock levers 234. These three components are fastened together, for example by a rivet 236, in slidable contact. The attachment 171 is secured to a wall by use of fasteners, such as installing a screw 238 through the base plate 230 into the wall.

The base plate track 230 has a semicircular portion 240 which opens downward and the sliding lock track 232 has a semicircular portion 242 which opens upward. When the cam lock levers 234 are turned in the direction of arrows 244, the levers 234 engage the underneath side of the sliding lock track 232 forcing the semicircular portion 242 of the sliding lock track 232 upwards toward the semicircular portion 240 of the base plate track 230. When the cam lock levers are fully closed (shown at points 246), the two semicircular portions 240 and 242 form a C-channel 248 having a small opening 250 along the front edge.

A series of attachments 171 is installed side-by-side in edgewise contact. The channel 248 extends substantially the width of the attachment 171, but leaves a gap 251 at each end of the attachment 171 sufficient for an arm 253 of a C-track-to-frame locking pin 252, which is coupled to the support pole 255, to pass between the adjacent channels 248. The arm 253 has a lock lug 254 that is captured by the channels 248 when the sliding lock track 232 is secured in the upward position. In addition to securing the locking pin 252, the C-track 248 captures the interlocking top edge 256 of the fabric panel 258. Therefore, both the support pole 255 and the fabric panel 258 are secured in place to protect the underlying structure from the weather.

It will be understood that certain combinations and subcombinations of the invention are of utility and may be employed without reference to other features in subcombinations. This is contemplated by and is within the scope of the present invention. As many possible embodiments may be made of this invention without departing from the spirit and scope thereof, it is to be understood that all matters hereinabove set forth or shown in the accompanying drawing are to be interpreted as illustrative and not in a limiting sense.

While the foregoing is directed to the preferred embodiment, the scope thereof is determined by the claims which follow:

What is claimed is:

1. A protective covering system comprising:

(a) a plurality of support poles comprising at least two elongate support members coupled together, each support pole having a first end, a second distal end, two guide channels, and means for securing the support poles in a spaced relation to a structure;

(b) a plurality of elongate cross braces having two ends coupled to adjacent support poles;

(c) flexible panel between each pair of adjacent support poles having a width spanning between adjacent support poles, a top interlocking edge, and two interlocking lateral edges slidably held within the guide channels of adjacent support poles; and (d) means for controllably raising and lowering each flexible panel secured between adjacent support poles wherein said means comprises:

(e) first and second pulleys inserted into the guide channels of adjacent support poles;

(f) a rotatable drum; and (g) an elongate cable along each guide channel having an extended end coupled to the interlocking lateral edge of the panel and a coiled end on the rotatable drum, and wherein the cable is guided over a pulley.

2. The system of claim 1 wherein the guide channels extend substantially the distance between the first and second ends of the support pole.

3. The system of claim 2 wherein the guide channels have a C-shaped cross-section.

4. The system of claim 3 wherein the C-shaped guide channel has a constant diameter and an elongate opening with a constant width over the length of the guide channel, and wherein the diameter of the guide channel is greater than the diameter of the interlocking lateral edge of the flexible panel, and wherein the width of the elongate opening is less than the diameter of the interlocking lateral edge of the flexible panel and greater than the thickness of the flexible panel.

5. The system of claim 4 wherein the flexible panel has a length substantially equal to the length of the support poles.

6. The system of claim 1 further comprising:

(g) means for tensioning the flexible panels.

7. The system of claim 1 further comprising a broad base member coupled to the first end of the support pole to distribute the weight of the support over a larger area of the substantially horizontal surface.

8. The system of claim 7 wherein the broad base member has a vertical support bar adjustably coupled to the first end of the support pole for setting the height of the support pole.

9. The system of claim 1 wherein the support poles are substantially vertical and the first end rests on a substantially horizontal surface.

10. The system of claim 1 further comprising:

(h) an adapter having a first end coupled to the distal end of a support pole and a second end having a horizontal shaft; and (i) a facia plate attached to a structure having a C-channel that can be opened for insertion of the horizontal adapter shaft and the top interlocking edge of the flexible panel, wherein the C-channel of the facia can be closed to securely hold the horizontal adapter shaft and the top interlocking edge of the flexible panel.

11. A method for installing a protective covering system comprising the steps of:

(a) positioning first and second support poles of substantially equal length in parallel alignment, each pole having a first end, a second distal end, and a guide channel;

(b) installing a plurality of elongate cross braces between the first and second support poles;

(c) temporarily securing a winch to a cross brace near the distal ends of the first and second support poles;

(d) temporarily attaching first and second pulleys to the distal end of the first and second support poles;

(e) threading first and second cables from the winch, over the first and second pulleys, and downward through the guide channels of the first and second support poles;

(f) coupling the first and second cables to a flexible panel having interlocking edges;

(g) cranking the winch to reel in the cable and thereby extend the flexible panel;

(h) during raising, slideably securing the interlocking edges within the guide channels;

(i) securing the flexible panel to the distal ends of the support poles; and (j) removing the pulleys and the winch.

12. The method of claim 11 comprising the steps of:

(k) repeating steps (a)–(j) on a second panel.

13. The method of claim 11 further comprising the steps of:

(k) attaching a facia plate to a structure;

(l) removing the pulleys and the winch;

(m) securing the distal ends of the first and second support poles to the facia plate; and (n) securing the fabric panel to the facia plate.

14. The method of claim 11 including the step of guiding parallel interlocking edges of the panel so that the panel is moved a specified distance along the guide channels, and the panel is moved to close the gap between the support poles.

15. The method of claim 13 further comprising the steps of:

(o) repeating steps (a)–(n) for a second panel.

16. A method for installing a protective covering system comprising the steps of:

(a) positioning first and second support poles of substantially equal length in parallel alignment, each pole having a first end, a second distal end, and a guide channel;

(b) installing a plurality of elongate cross braces between the first and second support poles;

(c) temporarily securing a winch to a cross brace near the distal ends of the first and second support poles;

(d) temporarily attaching first and second pulleys to the distal end of the first and second support poles;

(e) threading first and second cables from the winch, over the first and second pulleys, and downward through the guide channels of the first and second support poles;

(f) coupling the first and second cables to a flexible panel having interlocking edges;

(g) cranking the winch to reel in the cable and thereby extend the flexible panel;

(h) during raising, slideably securing the interlocking edges within the guide channels;

(i) attaching a facia plate to a structure;

(j) removing the pulleys and the winch;

(k) securing the distal ends of the first and second support poles to the facia plate; and (l) securing the fabric panel to the facia plate.

17. The method of claim 16 further comprising the steps of:

(m) securing the flexible panel to the distal ends of the support poles; and (n) removing the pulleys and the winch.

18. The method of claim 16 further comprising the steps of:

(m) repeating steps (a)–(l) for a second panel.

19. The method claim 17 further comprising the steps of:

(o) repeating steps of (a)–(n) for a second panel.

20. A protective covering system comprising:

(a) a plurality of support poles comprising at least two elongate support members coupled together, each support pole having a first end, a second distal end, two guide channels, and means for securing the support poles in a spaced relation to a structure;

(b) a plurality of elongate cross braces having two ends coupled to adjacent support poles;

(c) flexible panel between each pair of adjacent support poles having a width spanning between adjacent support poles, a top interlocking edge, and two interlocking lateral edges slidably held within the guide channels of adjacent support poles;

(d) means for controllably raising and lowering each flexible panel secured between adjacent support poles;

(e) an adapter having a first end coupled to the distal end of a support pole and a second end having a horizontal shaft; and (f) a facia plate attached to a structure having a C-channel that can be opened for insertion of the horizontal adapter shaft and the top interlocking edge of the flexible panel, wherein the C-channel of the facia can be closed to securely hold the horizontal adapter shaft and the top interlocking edge of the flexible panel.

21. The system of claim 20 wherein the guide channels extend substantially the distance between the first and second ends of the support pole.

22. The system of claim 20 wherein the means for controllably raising and lowering the fabric panels comprises:

(g) a rotatable drum;

(h) first and second pulleys aligned with the guide channels of adjacent support poles; and (i) an elongate cable slidably held within each guide channel having an extended end coupled to the interlocking lateral edge of the panel and a coiled end on the rotatable drum, and wherein the cable is guided over a pulley.

23. The system of claim 20 wherein the guide channels have a C-shaped cross-section.

24. The system of claim 23 wherein the C-shaped guide channel has a constant diameter and an elongate opening with a constant width over the length of the guide channel, and wherein the diameter of the guide channel is greater than the diameter of the interlocking lateral edge of the flexible panel, and wherein the width of the elongate opening is less than the diameter of the interlocking lateral edge of the panel and greater than the thickness of the flexible panel.

25. The system of claim 24 wherein the flexible panel has a length substantially equal to the length of the support poles.

26. The system of claim 20 further comprising means for tensioning the flexible panels.

27. The system of claim 20 further comprising a broad base member coupled to the first end of the support pole to distribute the weight of the support over a larger area of the substantially horizontal surface.

28. The system of claim 27 wherein the broad base member has a vertical support bar adjustably coupled to the first end of the support pole for setting the height of the support pole.

29. The system of claim 20 wherein the support poles are substantially vertical and the first end rests on a substantially horizontal surface.

* * * * *